United States Patent [19]

Fipp et al.

[11] 4,392,578

[45] Jul. 12, 1983

[54] STOPPER APPARATUS FOR CONTENT CONTAMINATION PREVENTION

[76] Inventors: Beverly A. Fipp; Bernard E. Fipp, both of 7728 Hidden Valley Ct.; John L. Haller, 7249 Carrizo Dr., all of La Jolla, Calif. 92037

[21] Appl. No.: 313,833

[22] Filed: Oct. 22, 1981

Related U.S. Application Data

[63] Continuation-in-part of Ser. No. 190,569, Sep. 25, 1980, abandoned, which is a continuation of Ser. No. 893,876, Apr. 6, 1978, abandoned.

[51] Int. Cl.[3] ..... B65D 39/12

[52] U.S. Cl. ..... 215/231; 215/269; 222/152; 222/386.5; 222/399; 222/401; 261/DIG. 7

[58] Field of Search ..... 222/152, 190, 386.5, 222/387, 389, 399, 400.8, 401; 215/231, 228, 260, 269, 309

[56] References Cited

U.S. PATENT DOCUMENTS

| | | | |
|---|---|---|---|
| 174,752 | 3/1876 | Young | 222/401 |
| 601,877 | 4/1898 | Lochmann | 222/400.8 X |
| 1,106,937 | 8/1914 | Goff | 222/400.8 |
| 2,063,430 | 12/1936 | Graser | 222/386.5 |
| 2,265,676 | 12/1941 | Stoddard | 222/152 X |
| 2,673,013 | 3/1954 | Hester | 222/386.5 |
| 3,129,857 | 4/1964 | Croy et al. | 222/400.8 |
| 3,248,118 | 4/1966 | Pechy | 222/152 X |
| 3,294,289 | 12/1966 | Bayne et al. | 222/386.5 X |
| 3,883,043 | 5/1975 | Lane | 222/152 X |
| 4,142,657 | 3/1979 | Wanke | 222/386.5 |

FOREIGN PATENT DOCUMENTS

| | | | |
|---|---|---|---|
| 1097770 | 1/1961 | Fed. Rep. of Germany | 222/386.5 |
| 180031 | 12/1936 | Switzerland | 222/401 |
| 1442699 | 7/1976 | United Kingdom | 222/386.5 |

*Primary Examiner*—Charles A. Marmor
*Attorney, Agent, or Firm*—Haller, John L.

[57] ABSTRACT

An improved stopper apparatus for bottles, such as wine bottles, which prevents contamination of the contents therein. The improved stopper apparatus comprises a stopper plug, a bladder attached thereto, a venting valve for venting gas within the bottle, a pump for inflating the bladder and a reservoir valve and inert gas reservoir. The bladder is inserted into the bottle and the stopper plug secured within the neck thereof. The bladder is filled within the bottle forcing the gas therein to escape through the venting valve. The stopper apparatus is adapted to enable a small quantity of heavy inert gas to be deposited into the bottle from the inner gas reservoir prior to filling the bladder, whereby to form a protective layer of inert gas over the surface of the bottle's contents.

5 Claims, 3 Drawing Figures

STOPPER APPARATUS FOR CONTENT CONTAMINATION PREVENTION

RELATED APPLICATIONS

This application is a Continuation-In-Part application of U.S. application Ser. No. 190,569, filed Sept. 25, 1980, and is now abandoned, which is in turn a Continuation of U.S. application Ser. No. 893,876, filed Apr. 6, 1978, and now abandoned.

BACKGROUND OF THE INVENTION

1. Field of the Invention

This invention relates to an improved bottle stopper apparatus for resealing bottles having contents which require protection from contamination. Specifically, this invention relates to the protection of bottled wine from contamination by air.

2. Brief Description of the Prior Art

Conventional prior art bottle stopping devices typically include provisions which merely prevent the escape of the contents of the bottle, such as, corks and expanding plugs which fit within the neck of the bottle, or snap-on devices which are secured on top of the bottle.

More sophisticated stopping devices may include pour spouts with venting holes which fit into the neck of the bottle, or pumping devices which also fit into the neck of the device and have tubes which extend into the bottle's contents and provide a means for drawing out its contents. To the best of the inventor's knowledge, there is no device which effectively plugs the bottle and prevents contamination of its contents.

SUMMARY OF THE INVENTION

This invention relates to an improved stopper apparatus for protecting the contents of the bottle from contamination by forcing the contaminating material out of the bottle and by dispensing a protective layer of heavy inert gas over the surface of the contents of the bottle.

The improved stopper apparatus includes a stopper plug and a bladder which is connected to the stopper plug and fits within the bottle when the plug is installed within the bottle's neck. Means are provided for inflating the bladder within the bottle whereby the gas contents of the bottle are expelled through a venting means.

The improved stopper apparatus also includes means for injecting a protective gas such as a heavy inert gas into the bottle which then serves as a protective barrier for the bottle's contents. Additionally, the improved stopper apparatus includes means for deflating the bladder.

Accordingly, it is an object of this invention to provide an improved stopper apparatus for a bottle which protects the contents thereof from contamination. A further object of this invention is to provide an improved stopper apparatus which includes provisions for injecting a protective substance into the bottle to provide a protective barrier for the bottle's contents.

BRIEF DESCRIPTION OF THE DRAWINGS

The following is a brief description of the accompanying drawings.

DESCRIPTION OF THE PREFERRED EMBODIMENT

Figure 1:
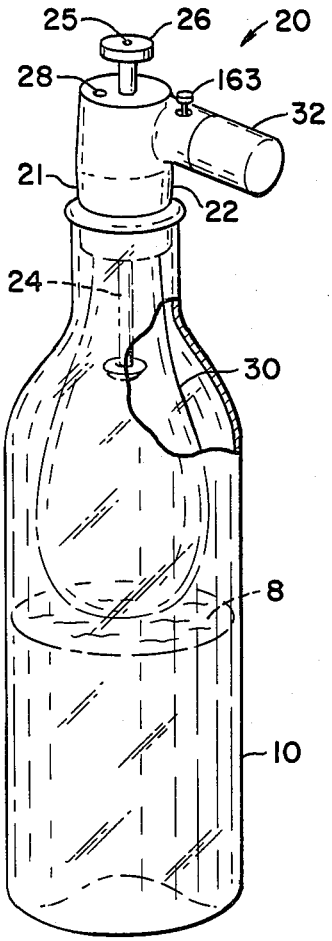
FIG. 1 is a prospective view of the bottle having the improved stopper apparatus installed.

FIG. 1 of the drawings illustrates the improved bottle stopper apparatus installed in an appropriate bottle. For purposes of discussion, the contents of the bottle will be assumed to be wine and the bottle stopper apparatus is use to prevent the contamination of the wine by air. It is understood that this discussion is for demonstration purposes only and that the stopper apparatus may be used for substantially any application whereby it is desired to protect the contents of the bottle or similar container from a contaminating environment.

FIG. 1 is a broken sectional view showing the stopper apparatus generally at 20 installed within a bottle 10 containing liquid 8. The stopper apparatus 20 includes a stopper plug 21 having a handle 23 and in inflatable bladder 30. The stopper plug 21 is secured within the neck of the bottle 12 by tapered sides 22 on the stopper plug 21. The stopper apparatus 20 also includes a bladder inflating tube 24 which is vented inside the bladder 30. The inflating tube 24 is coupled to a manual pump (not shown) having a pump handle 26 extending through the top of the stopper apparatus 20 with bladder deflating opening 25 therein.

In this embodiment, the manual pump (not shown) operates to force air through the inflating tube 24 into the bladder 30 filling it whereby the thus filled bladder 30 substantially occupies the vacant portion of the bottle 10. As the bladder 30 is inflated, it forces air within the vacant portions of the bottle 10 out through a venting hole 28 within the stopper plug 21.

The inert gas release valve 163 is shown protruding through the handle 32. The inert gas release valve 163, controls the injection of a heavy inert gas from an inert gas reservoir (not shown) into the bottle to provide a protective barrier between the wine and the air.

Figure 2:
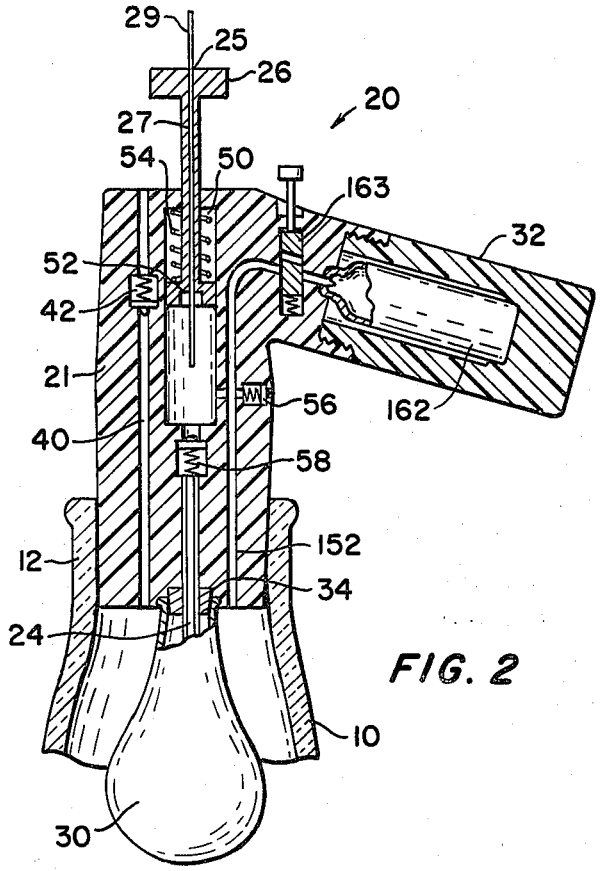
FIG. 2 is a sectional view of the improved stopper apparatus.

FIG. 2 of the drawings is a sectional diagram showing the basic improved stopper apparatus 20 with the convenience handle 32. The stopper plug 21 is shown inserted into the neck 12 of a bottle 10 whereby the stopper plug 21 substantially seals the bottle's neck 12. The bladder 30 is shown extending into the bottle 10 in a partially inflated condition. The bladder 30 is best structured to inflate in such a way that it expands downward then radially outward whereby the gas contents of the bottle 10 are more readily allowed to vent.

The inflating tube 24 is shown extending through a bladder ring 34, which seals the bladder 30 to the stopper plug 21, and into the bladder whereby a gas, such as air, is conducted to inflate the bladder 30. The stopper plug 21 includes a venting channel 40 and a unidirectional release valve 42 which operates to controllably vent the air within the bottle 10 as the bladder 30 is being inflated.

The manual pump 50 is shown with its plunger handle 26, plunger 52, return spring 54, inlet valve 56, and exit valve 58. Repetitive operations of the pump 50 force air to inflate the bladder 30. Both the inlet valve 56 and the exit valve 58 are unidirectional and designed to prevent the escape of the conents of the bladder 30. A bladder defining channel 27 and opening 25 are provided within the plunger handle 26 whereby a pin, 29, may be inserted therethrough to force open exit valve 58 to allow the bladder to exhaust its contents through the opening 25. As the manual pump 50 is pumped, the finger of the operator is positioned over the opening 25 to prevent the escape of air therethrough. A deposit channel 152, gas reservoir 162, and a gas release valve 163 are included whereby a heavy inert has, such as argon, may be deposited into the bottle.

In operation, the improved stopper apparatus 20 is securely inserted into the neck 12 of the bottle 10 to prevent the escape of air around the edges thereof. A small quantity of the protective gas is deposited into the bottle by momentarily depressing the gas release valve 163. The bladder 30 is inflated by operating the manual pump 50, thereby taking up substantially all of the free space within the bottle 10 and forcing the air within the bottle out through the unidirectional release valve 42 of the venting channel 40. The bladder 30 is later deflated by inserting a pin 29 through the opening 25 to force open exit valve 58 whereby the gas within the bladder vents through deflating channel 27 and opening 25.

The layer of heavy inert gas rests over the surface of the wine within the bottle. Then, inflating the bladder will take up and consume substantially all of the free space within the bottle, thus reducing the exposure of the bottle's contents to air within the bottle. In this fashion, the improved stopper apparatus provides a substantially complete protection for the content of the bottle, insofar as any free space within the bottle will be filled with the heavy inert gas. Substantial benefit is provided insofar as large volumes of heavy inert gas are not required to protect the contents, or alternatively, thin layers which do not provide protection from contaminating air when the bottle is slightly agitated. Also, the heavy inert gas fills any gaps within the bottle which may exist after inflation of the internal bladder.

Figure 3:
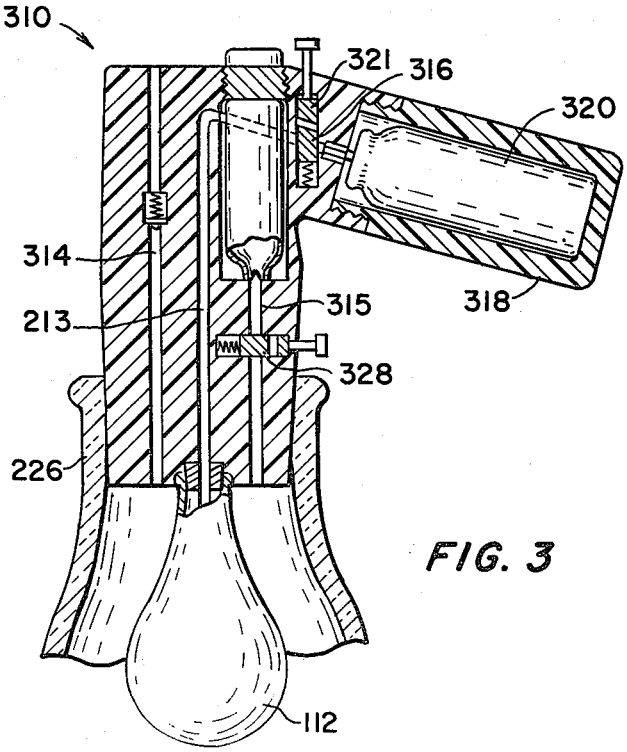
FIG. 3 is a sectional view of a second embodiment of the improved stopper apparatus inserted within the neck of a bottle having an automatic means for filling the bladder.

FIG. 3 shows an alternate embodiment of the improved stopper apparatus 310 adapted for automatically filling the bladder 112, which includes a venting means 314, a gas depositing means 315 and a inflating means 316. The venting means 314 is of conventional structure. The deposit means is similar to the structure of that shown in FIG. 2, yet positioned differently within the stopper plug 310.

The inflating means includes a canister of compressed air 320 which is located within the removable handle 318 of the automatic stopper plug 310. Inflating valve 321 is provided to controllably release the compressed air within the canister into the bladder through conventional inflating tube 213, and bladder 112.

In operation, the automatic stopper plug 310 is secured within the neck of the receiving bottle 226. The gas deposit valve 328 is momentarily depressed whereby a small quantity of heavy inert gas is injected into the bottle 226. The bladder 112 is then inflated by depressing the inflating valve 321 whereby the compressed air within the canister 320 is passed through the inflating tube 213 and used to fill the bladder 112 within the bottle 226. As the bladder 112 is filled within the bottle 226, the air within the bottle escapes through venting means 314.

It is understood that the description herein of my invention is done to fully comply with the requirements of 35 USC 112, and is not intended to limit the invention in any way. Thus, variant forms of the herein-described improved stopper apparatus, which are within the concept of the present invention, could easily be developed. Such variant forms are considered to be within the scope and essence of this invention.

What is claimed is:

1. An improved stopper apparatus for content contamination prevention for a container having an opening, said container being partially filled with a gaseous contaminant and partially filled with a liquid substance which is to be protected from contamination by said contaminant, said stopper apparatus comprising:

(a) stopper plug;

(b) a means for securing such stopper plug to said container opening;

(c) a bladder removably fixed to the bottom of said stopper plug wherey said bladder is positioned within said container when said stopper plug is secured within said container opening;

(d) said stopper plug includes a means for inflating said bladder, a means for venting said gaseous contaminants when said stopper plug is secured in said container opening, said inflating means including a means for deflating said bladder, in combination with;

(e) a means for depositing a protective gas into said container when said stopper plug is secured in said container opening;

(f) said means for venting including a one-way check valve permitting the expulsion of the gaseous contaminant, said means for inflating said bladder including a tube member extending into said bladder connected to a one-way check valve permitting said bladder to be filled and preventing the filled bladder from exhausting its contents.

2. An improved stopper apparatus, as recited in claim 1, wherein said inflating means comprises a reservoir of compressed gas, a means for releasing the compressed gas, a valve means for controllably dispensing a desired quantity of said released compressed gas, a first means for conducting said compressed gas from said releasing means to said valve means and a second means for conducting said compressed gas from said valve means to said bladder.

3. An improved stopper apparatus, as recited in claim 2, wherein said compressed gas is compressed air.

4. The improved stopper apparatus, as recited in claim 3, wherein said depositing means comprises a reservoir of compressed protective gas, a means for releasing the compressed protective gas, a valve means for controllable dispensing the desired quantity of released compresed protective gas, a first means for conducting said compressed protective gas from said releasing means to said valve means and a second means for conducting said compressed protective gas from said valve means to the interior of said container.

5. An improved stopper apparatus, as recited in claim 4 wherein said compressed protective gas is an inert gas having an atomic weight which is greater than the atomic weight of air.

* * * * *